US008006782B2

(12) United States Patent
Drivdahl et al.

(10) Patent No.: US 8,006,782 B2
(45) Date of Patent: Aug. 30, 2011

(54) SONIC DRILL HEAD

(75) Inventors: Kristian S. Drivdahl, Park City, UT (US); Robert Eugene Able, Bozeman, MT (US); Todd A. Nevenner, Murray, UT (US); Kenneth Carl Altrichter, Little Falls, MN (US)

(73) Assignee: Longyear TM, Inc., South Jordan, UT (US)

( * ) Notice: Subject to any disclaimer, the term of this patent is extended or adjusted under 35 U.S.C. 154(b) by 92 days.

(21) Appl. No.: 12/250,894

(22) Filed: Oct. 14, 2008

(65) Prior Publication Data

US 2010/0089646 A1 Apr. 15, 2010

(51) Int. Cl.
*E21B 7/24* (2006.01)

(52) U.S. Cl. ..... 175/55

(58) Field of Classification Search ..... 166/177.6, 166/177.1; 175/55, 56, 415, 189; 173/49; 384/517, 542, 563, 585
See application file for complete search history.

(56) References Cited

U.S. PATENT DOCUMENTS

| | | | | |
|---|---|---|---|---|
| 3,235,014 | A | 2/1966 | Brooks | |
| 4,012,154 | A * | 3/1977 | Durwin et al. | 403/261 |
| 4,152,943 | A | 5/1979 | Wall | |
| 4,362,431 | A | 12/1982 | Cochran | |
| 4,553,443 | A | 11/1985 | Rossfelder et al. | |
| 4,667,750 | A | 5/1987 | Wise et al. | |
| 4,802,539 | A * | 2/1989 | Hall et al. | 175/371 |
| 4,872,519 | A | 10/1989 | Kopecki | |
| 5,027,908 | A | 7/1991 | Roussy | |
| 5,417,290 | A | 5/1995 | Barrow | |
| 5,549,170 | A | 8/1996 | Barrow | |
| 5,562,169 | A | 10/1996 | Barrow | |
| 6,129,159 | A | 10/2000 | Scott et al. | |
| 6,248,020 | B1 * | 6/2001 | Morath et al. | 470/57 |
| 6,409,390 | B1 * | 6/2002 | Bouzakis et al. | 384/517 |
| 6,739,410 | B2 | 5/2004 | Smith et al. | |
| 6,968,910 | B2 | 11/2005 | Bar-Cohen et al. | |
| 7,066,250 | B2 | 6/2006 | Webb et al. | |
| 7,182,407 | B1 | 2/2007 | Peach et al. | |
| 7,270,182 | B2 | 9/2007 | Johnson, Jr. | |
| 7,607,498 | B2 * | 10/2009 | Roussy | 175/415 |
| 2004/0245020 | A1 | 12/2004 | Giroux et al. | |
| 2006/0225922 | A1 | 10/2006 | Pfahlert | |
| 2007/0120364 | A1 | 5/2007 | Casper et al. | |

OTHER PUBLICATIONS

International Search Report and Written Opinion dated Apr. 14, 2010 as issued in International Application No. PCT/US2009/060464 filed Oct. 13, 2009.

Cowan, W.S., Design Evaluaton of Preloaded Riser Connectors, 1982, Society of Petroleum Engineers. 1 page, [Online] [retrieved on Aug. 29, 2008] retrieved from the Internet http://www.onepetro.org/mslib/srvlet/onepetropreview?id=00010944&soc=SPE&speAP-PName.

(Continued)

*Primary Examiner* — Jennifer H Gay
*Assistant Examiner* — Kipp C Wallace
(74) *Attorney, Agent, or Firm* — Workman Nydegger

(57) ABSTRACT

A drill head assembly includes a shaft having a shaft axis, an oscillator assembly operatively associated with the shaft, the oscillator assembly having at least one eccentrically weighted rotor configured to rotate about a pivot point to generate an oscillating vibratory force, wherein an oscillation centerline is defined transverse to the shaft axis and including the pivot point. The drill head assembly also includes a lower bearing coupled to the shaft on a first side of the oscillation centerline and an upper bearing coupled to the shaft on a second side of the oscillation centerline, the second side being opposite the first side.

22 Claims, 5 Drawing Sheets

OTHER PUBLICATIONS

Barrow, Jeffrey C., The Resonant Sonic Drilling Method: An Innovative Technology for Environmental Restoration Programs, vol. 14, Issue 2, 1994 National Ground Water Association. 1 page, [Online] [retrieved on Aug. 29, 2008], retrieved from the Internet http://WileyInterScienceJOURNALSGroundWaterMonitoring &Remediation.

Xiao, Guo, High Frequency Vibration Recovery Enhancement Technology in the Heavy Oil Fields of China, 2004, Society of Petroleum Engineers. 1 page, [Online] [retrieved on Aug. 29, 2008] retrieved from the Internet http://www.spe.org/elibrary/servlet/spepreview?print=print&showSPEFavorites=false&title=SPE.

Glidden, G.L. Improved Wellhead Connector Design-Preload Production and Maintenance, 1984, Offshore Technology Conference. 1 page, [Online] [retrieved on Aug. 29, 2008] retrieved from the Internet http://www.onepetro.org/mslib/servlet/onepetropreview?id=OTC-4794-MS&soc=OTC&speAppN....

Johnson, Douglas B., Mechanical Performance of Composite Production Risers, 1999, Offshore Technology Conference. 1 page, [Online] [retrieved on Aug. 29, 2008] retrieved from the Internet http://www.onepetro.org/mslib/servlet/onepetropreview?id=OTC-11008-MS&soc=OTC&speApp,,,.

Taylor W.M., Modular Marine BOP Stack, 1986 IADC/SPE 1986 Drilling Conference. 1 page, [Online] [retrieved on Aug. 29, 2008] retrieved from the Internet http://www.onepetro.org/mslib/servlet/onepetropreview?id=00014750&soc=SPE&AppNameC....

Carstensen, Kenneth, Newly Designed API-Modified Sucker Rod Connection & Precision Makeup Method, 2004 Society of Petroleum Engineers. 1 page, [Online] [retrieved on Aug. 29, 2008] retrieved from the Internet http://www.onepetro.org/mslib/servlet/onepetropreview?id=00086920&soc=SPE&speAppNmaeC....

Badescu, Mircea, Rotary Hammer Ultrasonic/sonic Drill System, May 21, 2008 IEEE International Conference on Robotics and Automation (ICRA). 1 page, [Online] [retrieved on Aug. 29, 2008] retrieved from the Internet http://ras.papercept.net/conferences/scripts/abstract.pl?ConfID=11&Number=1115.

Woolsey, J. Robert, Rotary-Vibracore Drill, 2001 Offshore Technology Conference. 1 page, [Online] [retrieved on Aug. 29, 2008] retrieved from the Internet http://www.onepetro.org/mslib/servlet/onepetropreview?id=OTC-13095-MS&soc=OTC&speApp.

MacDonald, K. A., Stress analysis of drilling threaded connections using the finite element method, Mar. 1995 Engineer Failure Analysis, vol. 2, No. 1 pp. 1-30. 1 page, [Online] [retrieved on Aug. 29, 2008] retrieved from the Internet http://www.sciencedirect.com/science?_ob=ArticleURL&_udi=B6V2X-3YBB062-S&_user=10&.

Gonzales, Ozzie, The Extraction of Mud-StuckTublars Using Vibratory Resonant Techniques, 2007 Society of Petroleum Engineers, 1 page, [Online] [retrieved on Aug. 29, 2008] retrieved from the Internet http//:www.onepetro.org/mslib/servlet/onepetropreview?id=SPE-109530-MS&soc=SPE&speApp.

Jellison, Michael J., Ultradeep Drilling Pushes Drillingstring Technology Innovation, 2007, Society of Petroleum Engineers. 1 page, [Online] [retrieved on Aug. 29, 2008] retrieved from the Internet http://www.onepetro.org/mslib/servlet/onepetropreview?id-SPE-104827-MS&soc=SPE&speApp.

Badescu, M., Ultrasonic/sonic Driller/Corer as a hammer-rotary drill, May 2007, The Society for Optical Engineering, 1 page, [Online] [retrieved on Aug. 29, 2008] retrieved from the Internet http://spie.org/x648.xml?pf=true&product_id=716493&origin_id=x1636&Search_Results_URL=.

* cited by examiner

SONIC DRILL HEAD

BACKGROUND OF THE INVENTION

1. The Field of the Invention

The present invention relates to drill heads and to drill heads configured to generate oscillating vibratory forces.

2. The Relevant Technology

Core drilling allows samples of subterranean materials from various depths to be obtained for many purposes. For example, drilling a core sample and testing the retrieved core helps determine what materials are present or are likely to be present in a given formation. For instance, a retrieved core sample can indicate the presence of petroleum, precious metals, and other desirable materials. In some cases, core samples can be used to determine the geological timeline of materials and events. Accordingly, core samples can be used to determine the desirability of further exploration in a given area.

Although there are several ways to collect core samples, core barrel systems are often used for core sample retrieval. Core barrel systems include an outer tube with a coring drill bit secured to one end. The opposite end of the outer tube is often attached to a drill string that extends vertically to a drill head that is often located above the surface of the earth. The core barrel systems also often include an inner tube located within the outer tube. As the drill bit cuts formations in the earth, the inner tube can be filled with a core sample. Once a desired amount of a core sample has been cut, the inner tube and core sample can be brought up through the drill string and retrieved at the surface.

Sonic head assemblies are often used to vibrate a drill string and the attached coring barrel and drill bit at high frequency to allow the drill bit and core barrel to slice through the formation as the drill bit rotates. Accordingly, some drilling systems include a drill head assembly that includes both a sonic head assembly to provide the high frequency input and a rotary head to rotate the drill string. The sonic head includes eccentrically weighted rotors that are oscillated. The eccentrically weighted rotors are coupled to a shaft. The shaft can in turn be coupled to a drill rod such that turning the eccentrically weighted rotors transmits a vibratory force from the shaft to the drill rod.

In order to allow the rotation described above, a number of bearing configurations are often provided to support the shaft as it rotates. The life of the bearings depends, at least in part, on maintaining an appropriate pre-load to maintain contact between the bearings and the shaft. In the past, bearings have often been located in positions that required disassembly of the head in order to adjust the preload on the bearings. Adjusting the pre-load could also be tedious. If the pre-load was not maintained, the vibratory forces generated by rotation of the eccentrically weighted rotors would quickly destroy the bearings or other parts of the drill. These repairs would often result in substantial down-time as operators repaired or replaced the bearings or other components of the sonic head assembly.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A drill head assembly can include a shaft having a shaft axis, an oscillator assembly operatively associated with the shaft, the oscillator assembly having at least one eccentrically weighted rotor configured to rotate about a pivot point to generate an oscillating vibratory force, wherein an oscillation centerline is defined transverse to the shaft axis and includes the pivot point. The drill head assembly also includes a lower bearing coupled to the shaft on a first side of the oscillation centerline and an upper bearing coupled to the shaft on a second side of the oscillation centerline, the second side being opposite the first side.

A drill head assembly can include a shaft having a first end and a second end and an oscillator assembly configured to generate an oscillating force positioned between the first end and the second end of the shaft. At least one bearing can couple the shaft to the oscillator assembly. A preload assembly can be coupled to the shaft, the preload assembly including a base nut configured to be selectively secured in position on the shaft and preloaders configured to advance relative to the base nut to preload the bearing.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific examples which are illustrated in the appended drawings. It is appreciated that these drawings depict only typical examples of the invention and are therefore not to be considered limiting of its scope. Examples will be described and explained with additional specificity and detail through the use of the accompanying drawings in which.

Figure 1A:
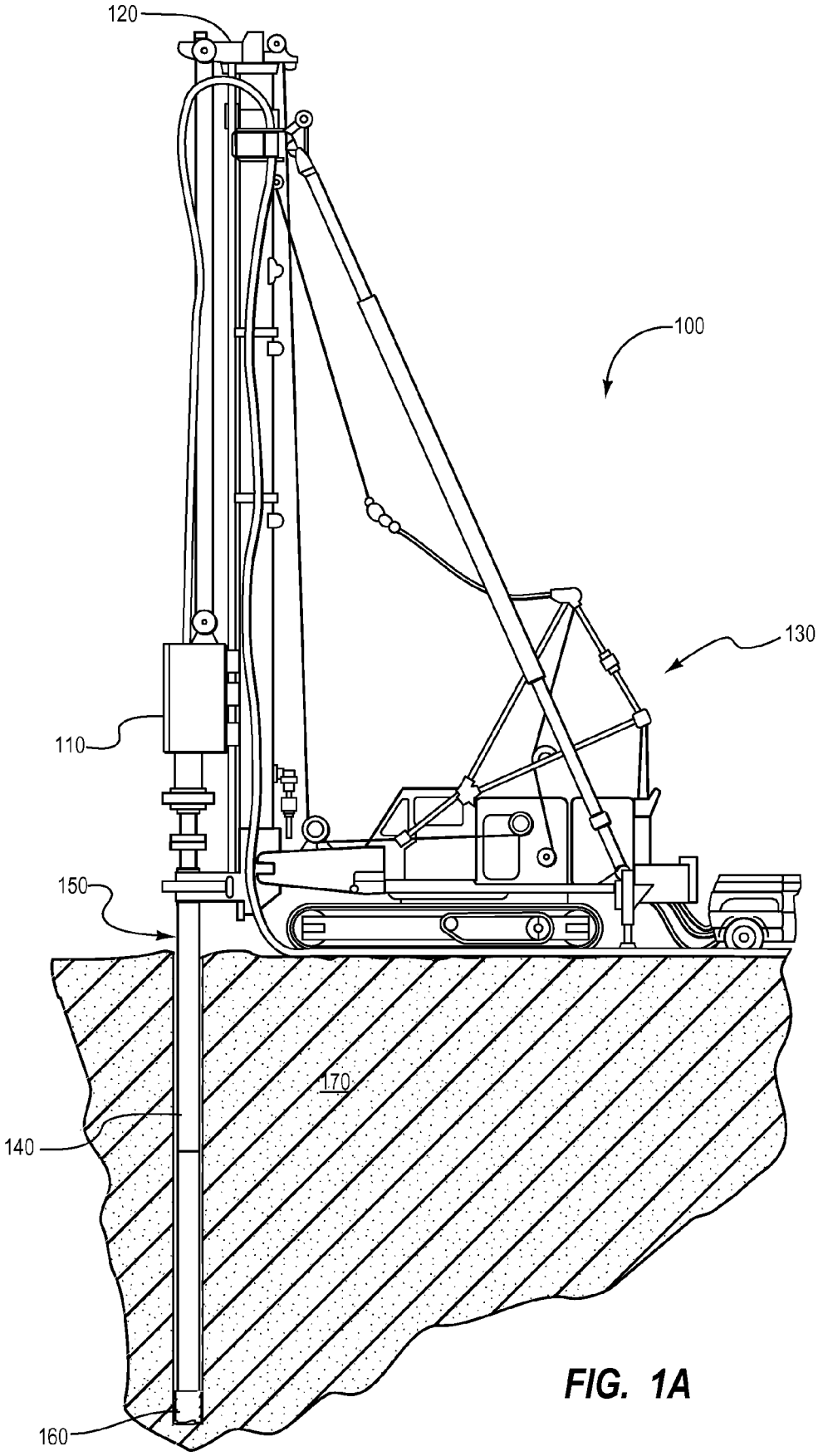
FIG. 1A illustrates a drilling system according to one example.

Together with the following description, the figures demonstrate non-limiting features of exemplary devices and methods. The thickness and configuration of components can be exaggerated in the figures for clarity. The same reference numerals in different drawings represent similar, though not necessarily identical, elements.

DETAILED DESCRIPTION OF THE PREFERRED EMBODIMENTS

Drilling systems, sonic head assemblies, as well as shaft and bearing assemblies are provided herein. In at least one example, a shaft and bearing assembly is provided that includes upper and lower bearings that allow a shaft to rotate relative to additional components, such as an oscillator assembly and/or a vibration isolation device, such as an air spring assembly. The oscillator assembly is configured to generate oscillating forces that are transmitted to the shaft.

In at least one example, the upper and lower bearings are located on opposing outward sides of the components. Such a configuration can unfetter the ends of the shaft, which in turn can facilitate coupling of a water pivot to one end of the shaft. Further, such a configuration can facilitate access to one or more of the bearings, which in turn can allow for regular preload adjustments. For example, a preload assembly can be associated with a shaft and bearing assembly. The preload assembly can include a base that is configured to be moved into proximity with the upper bearing and secured in place. With the base locked in position one or more preloader(s) can be advanced from the base to apply a preload force to the bearings.

In at least one example, the preload assembly includes a jacknut assembly having a base nut and preload bolts coupled to the base nut. The base nut can include internal threading that is configured to be threaded onto external threading on the shaft and advanced into proximity with the upper bearing. The base nut can then be locked in position on the shaft by a locking feature, such as a set screw. Thereafter, the preload bolts can be advanced relative to the locked base nut toward the bearings to thereby apply a preload force. The preload force can help maintain the bearings in contact with the shaft as the shaft moves in response to oscillating forces generated by the oscillator assembly.

If the shaft is allowed to move in and out of contact with the bearings due to the oscillating forces, the oscillation can result in significant impact forces between the bearing races and the bearings. These impact forces can quickly destroy the bearings. Accordingly, maintaining the bearing races and bearings in contact can help prevent premature failure of the bearings. The configuration of the preload assembly allows convenient access for a user to adjust the preload as the bearings wear. While a sonic head assembly is described below, it will be appreciated that the bearing and/or preload configurations described below can be applicable to any type of drill head or drilling equipment.

FIG. 1A illustrates a drilling system 100 that includes a drill head assembly 110. The drill head assembly 110 can be coupled to a mast 120 that in turn is coupled to a drill rig 130. The drill head assembly 110 is configured to have a drill rod 140 coupled thereto. The drill rod 140 can in turn couple with additional drill rods to form a drill string 150. In turn, the drill string 150 can be coupled to a drill bit 160 configured to interface with the material to be drilled, such as a formation 170.

In at least one example, the drill head assembly 110 is configured to rotate the drill string 150. In particular, the rotational rate of the drill string 150 can be varied as desired during the drilling process. Further, the drill head assembly 110 can be configured to translate relative to the mast 120 to apply an axial force to the drill head assembly 110 to urge the drill bit 160 into the formation 170 during a drill process. The drill head assembly 110 can also generate oscillating forces that are transmitted to the drill rod 140. These forces are then transmitted from the drill rod 140 through the drill string 150 to the drill bit 160.

Figure 1B:
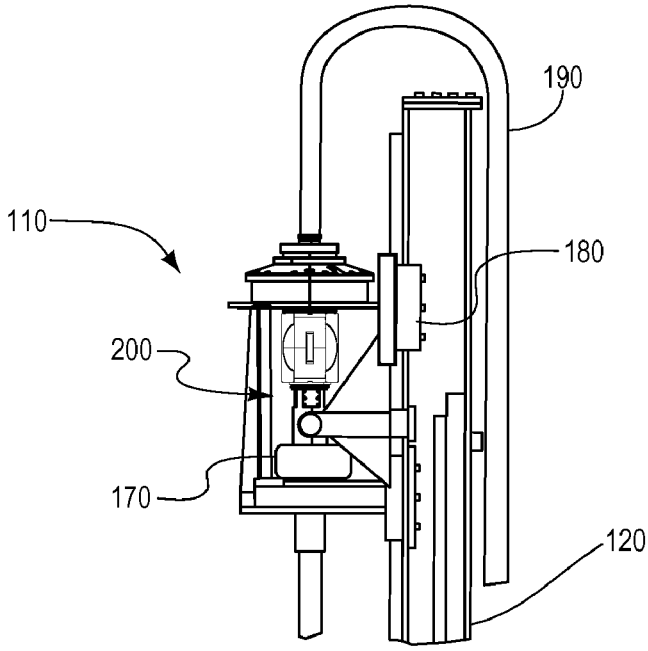
FIG. 1B illustrates a drilling head that includes a sonic head assembly and a rotary head assembly according to one example.

FIG. 1B illustrates the drill head assembly 110 in more detail. As illustrated in FIG. 1B, the drill head assembly 110 can include a rotary head assembly 170 mounted to a sled 180. The drill head assembly 110 can further include a sonic head assembly 200 mounted to the sled 180. In the illustrated example, a water coupling 190, such as a hose, is coupled to the sonic head assembly 200. As will be described in more detail below, the sonic head assembly 200 includes a bearing configuration and/or a preload assembly that can be readily accessed and adjusted.

Figure 2A:
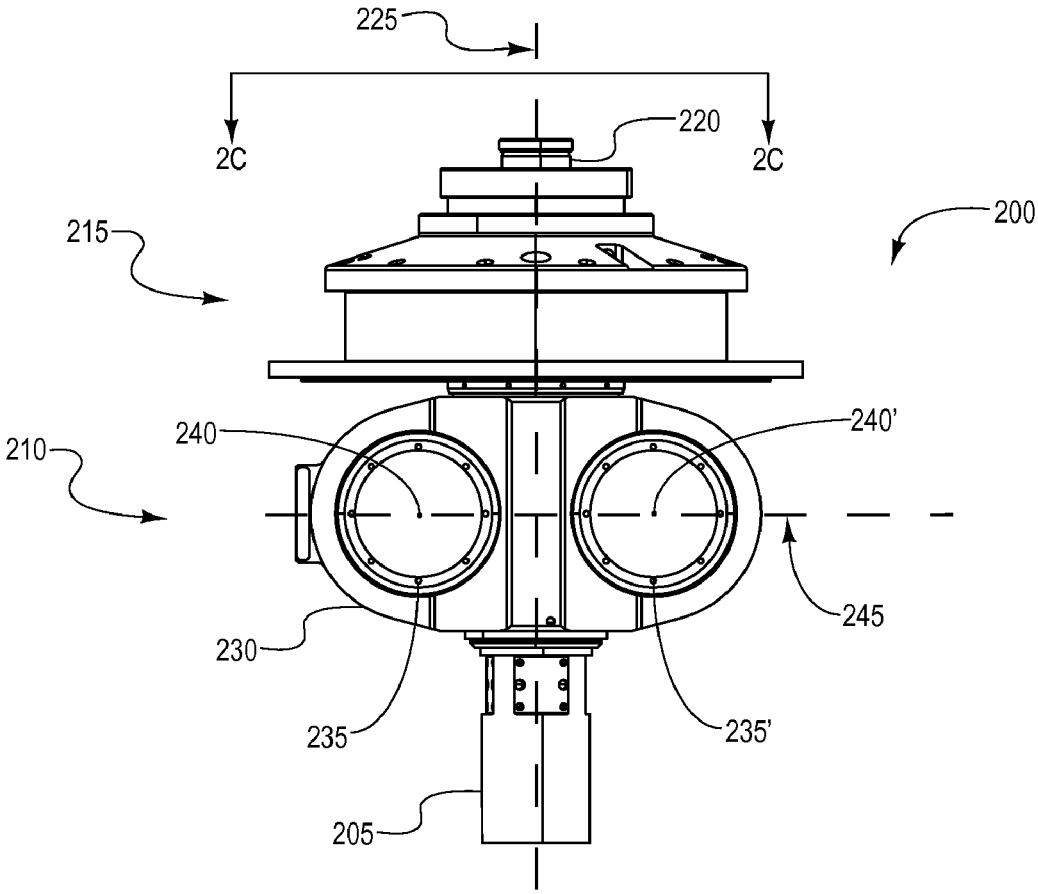
FIG. 2A illustrates an assembled view of a sonic head assembly according to one example.

FIG. 2A illustrates an isolated elevation view of the sonic head assembly 200 in more detail. As illustrated in FIG. 2A, the sonic head assembly 200 generally includes a shaft 205 and an oscillator assembly 210. The sonic head assembly 200 can also include a vibration isolation device, such as an air spring assembly 215. The shaft 205 is configured to pass at least partially through the oscillator assembly 210 and the air spring assembly 215.

In the illustrated example, the shaft passes through the oscillator assembly 210 and the air spring assembly 215 to a water swivel coupling 220. The shaft 205 can have a water channel defined therein. The water swivel coupling 220 can be coupled to the shaft 205 so as to be generally coaxial with the shaft axis 225.

The oscillator assembly 210 includes an oscillator housing 230 that supports eccentrically weighted rotors 235, 235'. The eccentrically weighted rotors 235, 235' are configured to rotate about axes 240, 240' to generate cyclical, oscillating centrifugal forces. A line between the two axes 240, 240' can be referred to as an oscillation centerline 245. Centrifugal forces due to rotation of the eccentrically weighted rotors 235, 235' can be resolved into a first component acting parallel to the shaft axis 225 and a second component acting transverse to the shaft axis 225. In the illustrated example, the second component also acts parallel to the oscillation centerline 245.

In at least one example, the eccentrically weighted rotors 235, 235' rotate in opposite directions. Further, the eccentrically weighted cylinders 235, 235' can be oriented such that as they rotate the second component of the centrifugal forces acting transverse to the shaft axis 225 cancel each other out while the first components acting parallel to the shaft axis 225 combine, resulting in oscillating vibratory forces.

These oscillating vibratory forces are transmitted to the oscillator housing 230. As previously introduced, the shaft 205 passes at least partially through the oscillator housing 230. Accordingly, the centrifugal forces described above can be transmitted from the oscillator housing 230 to the shaft 205. The shaft 205 then transmits the forces to other components, such as a drill rod and/or a rotary head, as described above.

The air spring assembly 215 can be operatively associated with the oscillator assembly 210 and/or the shaft 205. In at least one example, the air spring assembly 215 couples the sonic head assembly 200 to a support structure, like a sled (180, FIG. 1B) or housing, which in turn can be coupled to a mast (120, FIG. 1B). Accordingly, the air spring assembly 215 can help isolate the support structure, including the sled and/or mast from the vibratory forces associated with operation of the oscillator assembly 210 while allowing the shaft 205 to move up and down in response to those forces.

As discussed in more detail below, the sonic head assembly 200 can include bearings located on opposing sides of the oscillation centerline 245. The bearings can also be located on opposing sides of various components of the air spring assembly 215, as will be discussed in more detail with reference to FIGS. 2B and 2C. In particular, arrangement of various components of the sonic head assembly 200 will be discussed with reference to FIG. 2B, followed by a discussion of the interaction of those components with reference to FIG. 2C.

Figure 2B:
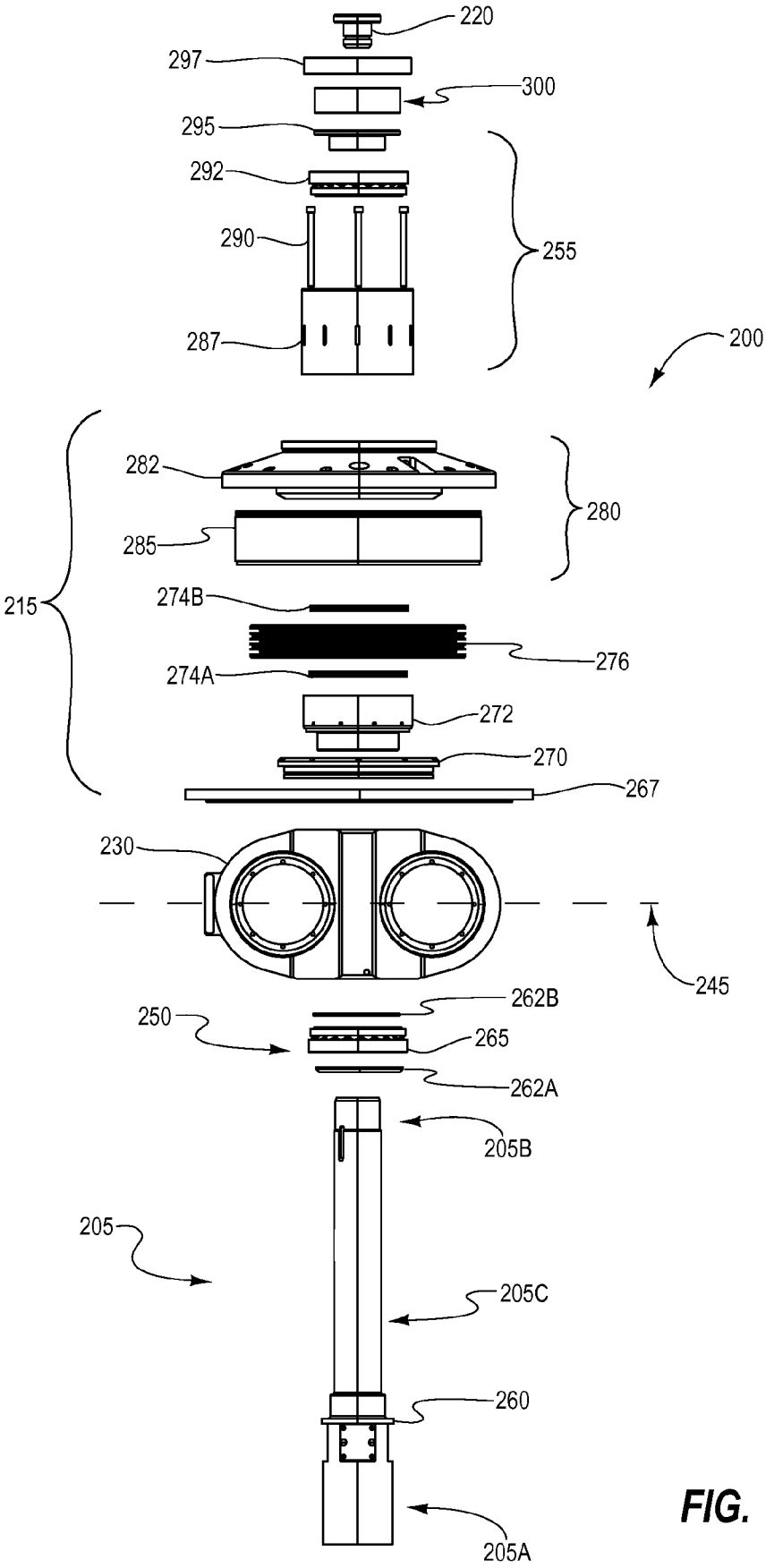
FIG. 2B illustrates an exploded view of the sonic head assembly of FIG. 2A.

FIG. 2B illustrates an exploded view of the sonic head assembly 200 of FIG. 2A. As illustrated in FIG. 2B, the sonic head assembly 200 includes at least a lower bearing assembly 250, an upper bearing assembly 255, and a preload assembly 300. The lower bearing assembly 250 is positioned on the shaft 205 on one side of the oscillation center 245 while the upper bearing assembly 255 is positioned on the shaft 205 on an opposing side of the oscillation centerline 245. Such a configuration allows the shaft 205 to rotate about the bearing assemblies 250, 255 relative to the oscillator housing 230.

The preload assembly 300 can be associated with the shaft 205 to provide a preload to at least one of the upper or lower bearing assemblies 250, 255. Further, one or more preload assembly can be associated with the shaft 205 in proximity with either or both of an upper bearing assembly and a lower bearing assembly. In the illustrated example, the preload assembly 300 is in proximity with the upper bearing assembly 255. The arrangement of the components, relative to the shaft 205 will now be discussed.

The shaft 205 generally includes a first end 205A and a second end 205B. The second end 205B can pass through any number of components of the sonic head assembly 200 to position the lower bearing assembly 250 and the upper bearing assembly on opposing sides of the oscillation centerline 245. In the illustrated example, the second end 205B is configured to pass through the lower bearing assembly 250, the oscillator assembly 210, the air spring assembly 215, the upper bearing assembly 255, and at least partially through the preload assembly 300.

The first end 205A of the shaft 205 can be configured to interface with a downstream component such as a rotary head or other component. The first end 205A can also be configured to pass through a rotary head and directly engage a drill rod. Further, the first end 205A can have any configuration desired.

The shaft 205 can include a center portion 205C between the first end 205A and the second end 205B. In at least one example, at least one portion of the shaft 205A, such as the center portion 205C can be formed by a process that produces a fatigue-resistant finish. In one such example, the process can include a surface finishing process, such as a nitriding process. Such process can include a koleen process, including a quench-polish-quench process. Such a process can reduce defects on the surface of any number of components, that can include wear/fatigue components such as the shaft 205, an upper bearing mount 285 and a piston mount 272, which can reduce sites from which cracks or other surface failures can initiate and propagate. Reducing the propagation of surface failures can help increase the life of the shaft 205.

The center portion 205C can be configured to rotate relative to the oscillator assembly 210 and/or the air spring assembly 215. A shoulder 260 can be formed between the center portion 205C and the first end 205A. The shoulder 260 can be configured to support the lower bearing assembly 250. In particular, the lower bearing assembly 250 can include lower and upper spacers 262A, 262B respectively and a lower bearing 265.

The shoulder 260 is configured to support lower spacer 262A that in turn supports the lower bearing 265. The lower bearing 265 can be any type of bearing. In at least one example, the lower bearing 265 can be an tapered roller bearing. The upper spacer 262B can be positioned between the lower bearing 265 and the oscillator housing 230. Accordingly, the lower bearing 265 can be positioned between the oscillator housing 230 and the first end 205A of the shaft 205 to allow the shaft 205 to rotate relative to the oscillator housing 230.

By way of introduction, the upper bearing assembly 255 is configured to allow the second end 205B to rotate relative to the oscillator housing 230, though the upper bearing assembly 255 is spaced from the oscillator housing 230 by the air spring assembly 215. While the configuration illustrated includes an air spring assembly 215 between the oscillator assembly 210 and the upper bearing assembly 255, it will be appreciated that the upper bearing assembly 255 can be positioned adjacent the oscillation assembly 210 and/or the air spring assembly 215 can be omitted. Additional bearings can be included as desired.

Continuing with the example illustrated in FIG. 2B, the air spring assembly 215 can include a lower plate 267, a lower seal 270, a piston mount 272, a lower bumper 274A, an upper bumper 274B, an air piston 276, and a top cover assembly 280 that includes a top cover 282 and a liner 285. The piston mount 272 can be secured to the oscillator housing 230. The air piston 276 can be secured to the piston mount 272. The upper bearing assembly 255 can be secured to the air piston 276. In particular, in at least one example, the upper bearing assembly 255 includes an upper bearing mount 287 secured to the air piston 276.

Figure 2C:
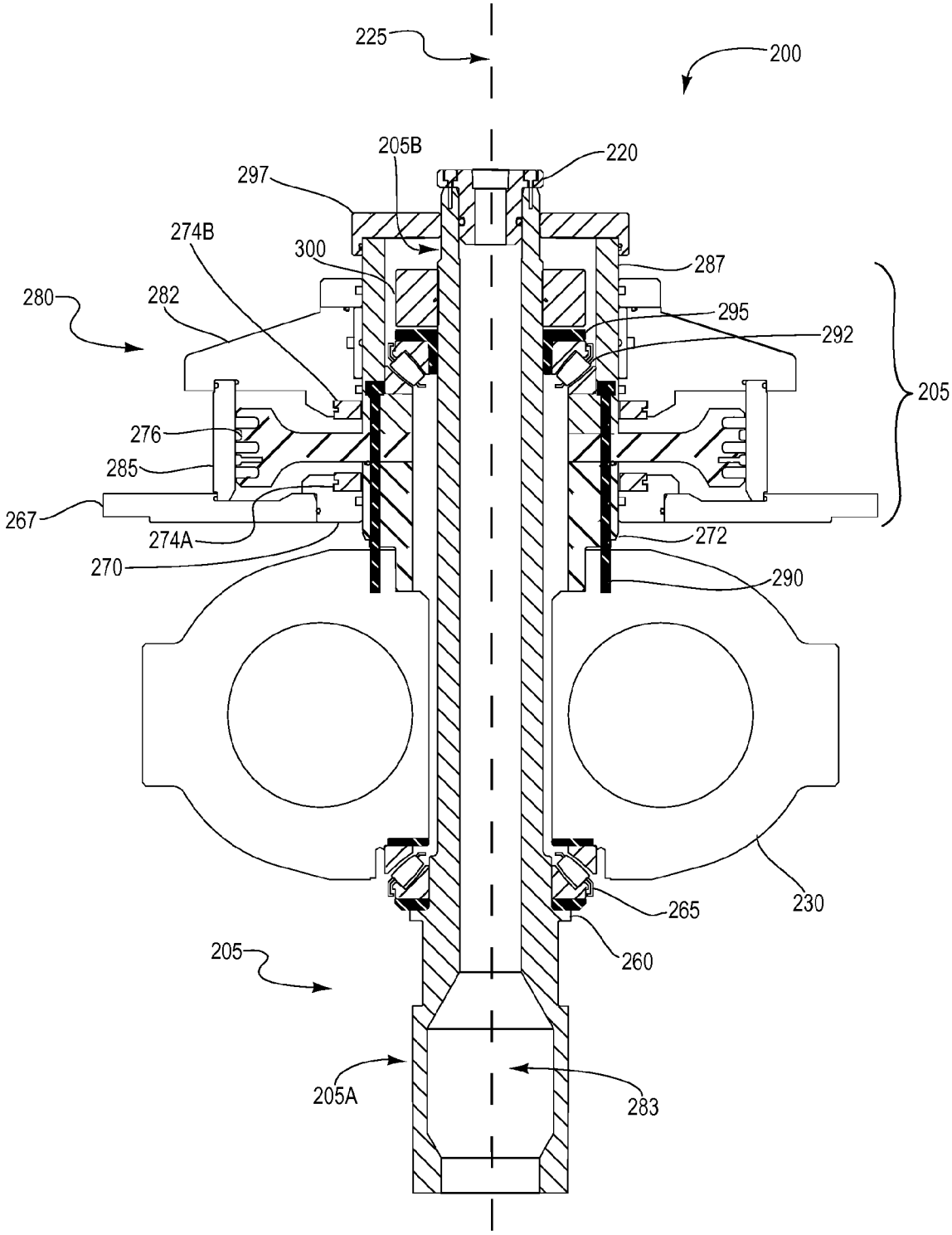
FIG. 2C illustrates a cross sectional view of the sonic head assembly of FIG. 2A taken along section 2C-2C.

In particular, as illustrated in FIG. 2C, fasteners, such as bolts 290 can extend through the upper bearing mount 287, the air piston 278, the piston mount 272, and into the oscillator housing 230. Accordingly, the upper bearing mount 287, the air piston 276, the piston mount 272, and the oscillator housing 230 can be secured together to form a stack.

Turning briefly to FIG. 2B, the upper bearing assembly 255 further includes an upper bearing 292 and an upper bearing spacer 295. The upper bearing mount 287 is configured to support the upper bearing 292 that in turn is configured to support the upper bearing spacer 295. As illustrated in FIG. 2C, the preload assembly 300 is further configured to apply a preload force to the upper bearing 292 and/or the lower bearing 265. In at least one example, the preload assembly 300 can be positioned near the second end 205B of the shaft 205 in proximity with the upper bearing 292, such as in contact with the upper bearing spacer 295.

The preload assembly 300 can be secured in place to apply a force on the upper bearing spacer 295 to urge the upper bearing 292 toward the first end 205A of the shaft 205. A top seal plate 297 can be coupled to the upper bearing mount 287. The top seal plate 297 can help protect the upper bearing 292 and other components from contamination during operation. Further, the location of the top seal plate 297 can allow the top seal plate 297 to be easily removed to provide access to the preload assembly 300 to maintain the preload on the bearings. Accordingly, the configuration of the sonic head assembly 200 can provide ready access to the preload assembly 300 to maintain preload on the bearings 292, 265. The sonic head assembly can also be configured to reduce the vibratory forces transmitted to a support structure through the air spring assembly.

As previously introduced, the upper bearing mount 287, the air piston 278, the piston mount 272, and the oscillator housing 230 form a stack. The lower bearing 265 can be positioned on an opposing side of the stack and held in place by the shoulder 260. The shaft 205 can be substantially rigid, such that the force the preload assembly 300 applies to the upper bearing spacer 295 can act to move the upper bearing 292, the stack, and the lower bearing 265 toward the shoulder 260. The resulting force can be referred to as a preload force. Accordingly, the preload assembly 300 can be configured to apply a preload force to help maintain the bearings coupled to the stack as the stack moves in response to the operation of the oscillator assembly 210.

Operation of the air spring assembly 205 will now be issued. As illustrated in FIG. 2C, the air spring assembly 205 includes the seal 270 that is configured to be sealingly coupled to the piston mount 272. The lower plate 267 in turn is configured to be sealingly coupled to the lower seal 270 and to the top cover assembly 280 to provide a chamber. The chamber can be pressurized to suspend the air piston 276.

As previously introduced, the air piston 276 can be part of a stack that also includes the upper bearing mount 287, the air piston 278, the piston mount 272, and the oscillator housing 230. The stack can translate as the oscillator assembly 210 operates to transmit oscillating forces to the shaft 205 through the lower bearing assembly 250. As the stack oscillates, the air piston 276 can move generally parallel to the shaft axis 225 in opposition to the pressure forces on the piston. The bumpers 274A, 274B can cushion contact between the air piston 276 and the lower seal 270A or top cover 282 respectively in cases where forces on the sonic head assembly 200 are greater than the cushioning force acting on the air piston 278 due to pressure on the air piston 276. In addition to providing isolation from the vibratory forces, the sonic head assembly 200 can be configured to direct water or other fluids to a drill string.

For example, as illustrated in FIG. 2C, a water channel 283 can be defined between the first end 205A and the second end of the shaft 205B. The configuration of the sonic head assembly 200 can position the second end 205B of the shaft 205 above the other components, including the oscillator assembly 210 and the air spring assembly 215. Such a configuration can allow the water swivel 220 to be positioned inline with the shaft 205, such that a hose or other water source can be coupled and uncoupled from the water swivel 220. Further, such a configuration can provide ready access to the preload assembly 300.

Figure 3:
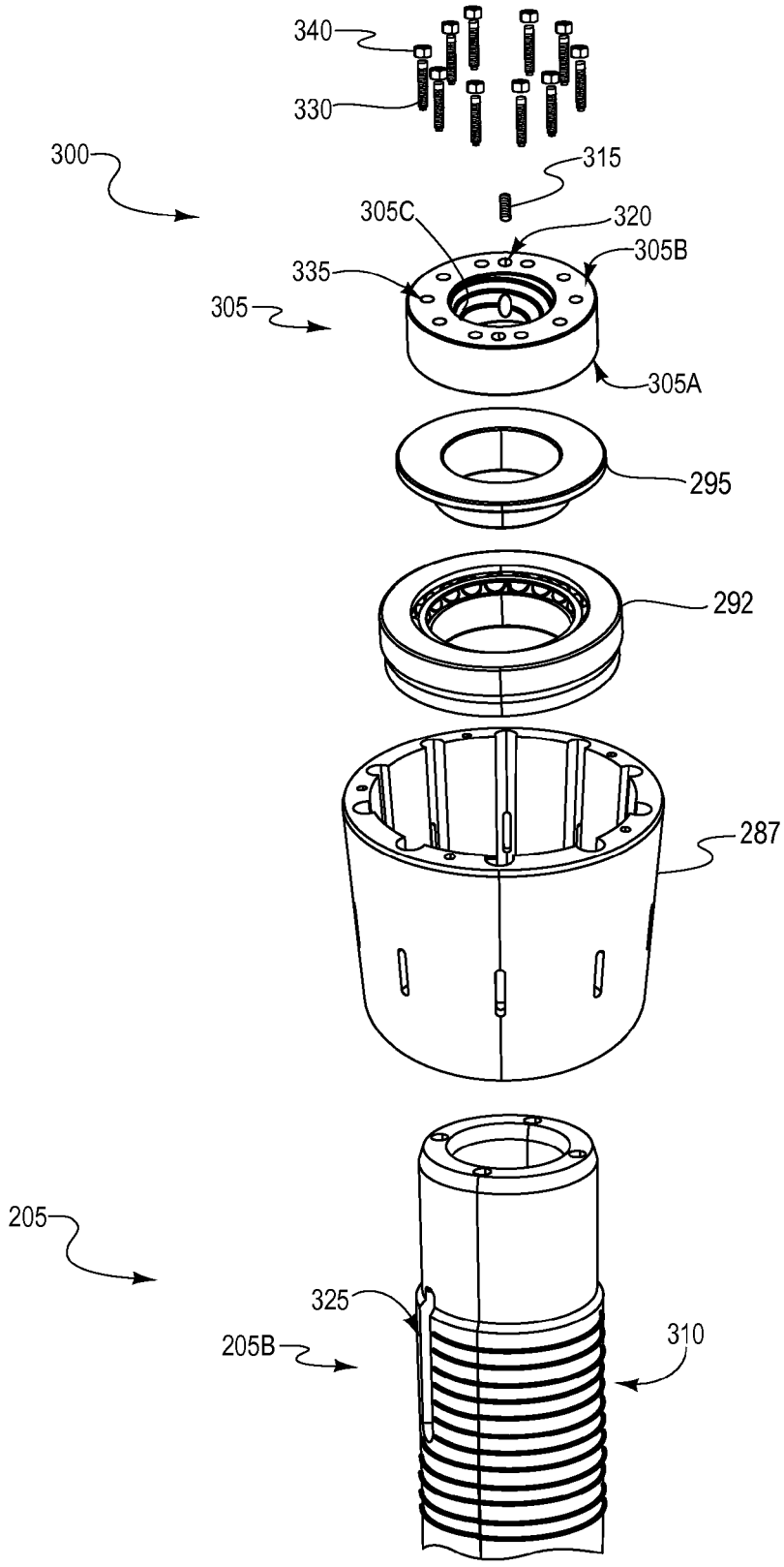
FIG. 3 illustrates an exploded view of a preload assembly according to one example.

FIG. 3 illustrates an exploded view of the preload assembly 300 in more detail. In the illustrated example, the preload assembly 300 can include a jack nut configuration. Accordingly, the preload assembly 300 can include a base member, such as a base nut 305 that is configured to be positioned on the second end 205B of the shaft 205 in proximity to the upper bearing spacer 295. The base nut 305 can include a lower portion 305A, an upper portion 305B, and an inner portion 305C. The inner portion 305C can be configured to engage corresponding features on the shaft 205 and the second end 205B in particular.

In at least one example, the inner portion 305C includes internal threads formed therein configured to engage a corresponding threaded portion 310 of the second end 205B of the shaft 205. The preload assembly 300 can further include a locking member, such as a set screw 315 that is configured to selectively secure the base nut 305 at a selected position on the shaft 205. In the illustrated example an angled opening 320 is defined in the preload assembly 300 that is in communication with the inner portion 305C. In particular, the angled opening 320 can extend through the upper portion 305B and into communication with the inner portion 305C of the base nut 305. The opening 320 can also have internal threads configured to engage corresponding external threads on the set screw 315. Accordingly, when the base nut 305 is positioned on the second end 205B of the shaft 205, the set screw 315 can be advanced through the opening 320 into engagement with the shaft 205.

In at least one example, a keyed portion 325 can be formed in the threaded portion 310 on the second end 205B of the shaft 205. Such a configuration can allow the set screw 315 to be tightened into secure engagement with the keyed portion 325 rather than the threads in the threaded portion 310. Such a configuration can reduce damage to the threads in the threaded portion 310 when securing the base 305 in position on the shaft 205. Further, engagement between the set screw 315 and the keyed portion 325 can help prevent rotation of the base nut 305, which can maintain the base nut 305 in position on the shaft 205.

The preload assembly 300 further includes preloaders, such as socket cap bolts 330. The bolts 330 are configured to be threaded through openings 335 that extend from the upper portion 305B through the lower portion 305A. When the base nut 305 is secured in position on the second end 205B, the bolts 330 can be advanced into contact with the upper bearing spacer 295. Further advancing the bolts 330 toward the upper bearing spacer 295 can preload the lower bearing 265 (FIGS. 2B-2C) and the upper bearing 292 as described above.

Once the bolts 330 are tightened to preload the bearings 265, 292 a desired amount, the bolts 330 can be locked in place. For example, lock nuts 340 can be threaded onto the bolts 330 and tightened to the base nut 305. Locking the bolts 330 in place can help reduce the possibility that the bolts 330 will loosen during operation of the sonic head assembly (200; FIG. 2A), thereby helping maintain the preload on the bearings 265, 292. Accordingly, the preload assembly 300 is configured to establish and maintain preload on the bearings 265, 292. Further, the configuration of the sonic head assembly 200 can provide ready access to the preload assembly 300 to maintain the preload. One example of maintaining preload on bearings will now be discussed in more detail.

In at least one example, a method of maintaining bearings includes a preliminary step of assembling a sonic head assembly. Such an example can include locating one or more bearings on opposing sides of an oscillation centerline of an oscillator assembly. The step of assembling the sonic head assembly can also include positioning a preload assembly on a shaft near an upper end of the sonic head assembly. One such configuration is described above with reference to FIGS. 2A-2C.

The preload assembly can include a base portion, a locking member, and a preload member. The base portion can be moved into proximity with an upper bearing. The base portion can then be secured in place on the shaft. Thereafter, preloaders can be advanced to apply a preload force. In at least one example, the preloaders can be tightened to a preload force of up to about 250,000 lbf, such as a preload force of between about 70,000 lbf to about 90,000 lbf. The preloaders can then be locked in to place relative to the base member.

The sonic head assembly can then be operated. As the sonic head assembly operates, the bearings wear and the preload decreases. The preload assembly can be periodically accessed to maintain preload on the bearings. For example, the preload assembly can be accessed and the preloaders tightened to a desired torque setting after a period of up to about 2,000 hours. Such a method can help ensure that the bearings are maintained in contact with the shaft and/or other portions of the sonic head assembly, which can help reduce premature failure of the bearings.

Various configurations have been discussed herein for positioning bearings relative to an oscillator assembly and for preloading bearings relative to the oscillator assembly. While at least one configuration for positioning bearings on opposing sides of an oscillation centerline have been described in the context of a preload assembly having a jack nut positioned near a top of the sonic head assembly, it will be appreciated that the bearing position can be considered separately from the position and function of the preload assembly and that each may take various configurations. For example, a preload assembly similar to that described above can be provided in which the bearings are located on one side of an oscillator assembly. Further, bearings and preload assemblies can be positioned independently of the position of the air spring assembly. In fact, in at least one example the air spring assembly can be omitted entirely. In other examples, preload assemblies can be provided that include a cone and lock nut type configuration or other configurations in which a locknut secures the position of the preload assembly relative to a bearing.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drill head assembly, comprising:

a shaft having a shaft axis and a plurality of external threads;

an oscillator assembly operatively associated with the shaft, the oscillator assembly having at least one eccentrically weighted rotor configured to rotate about a pivot point to generate an oscillating vibratory force, wherein an oscillation centerline is defined transverse to the shaft axis and including the pivot point;

a lower bearing coupled to the shaft on a first side of the oscillation centerline;

an upper bearing coupled to the shaft on a second side of the oscillation centerline, the second side being opposite the first side;

an internally threaded base nut adapted to be selectively secured in position on the shaft by engaging the plurality of external threads;

a bearing spacer moveably secured on the shaft between the upper bearing and the base nut; and a plurality of bolts biased against the based nut, wherein advancement of the plurality of bolts relative to the base nut forces the bearing spacer away from the base nut thereby applying a preload to the lower bearing and the upper bearing.

2. The drill head assembly of claim 1, wherein the shaft includes a first end and a second end, wherein the first end of the shaft is located toward a bit end relative to the oscillator assembly and wherein the second end is located on an opposing side of the oscillator assembly.

3. The drill head assembly of claim 2, further comprising an air spring assembly coupled to the shaft.

4. The drill head assembly of claim 3, wherein the air spring assembly includes an air piston positioned between the upper bearing and the oscillator assembly.

5. The drill head assembly of claim 3, wherein the plurality of bolts are configured to apply a preload force to the air spring assembly.

6. The drill head assembly of claim 5, wherein the base nut, plurality of bolts, and bearing spacer are positioned on the second end of the shaft.

7. The drill head assembly of claim 2, further comprising a keyed portion extending along the second end of the shaft through the plurality of external threads.

8. The drill head assembly of claim 7, further comprising an air spring assembly having an air piston coupled to the shaft between the oscillator assembly and the upper bearing, wherein the preload assembly is positioned on the second end of the shaft on an opposing side of the upper bearing from the air piston.

9. The drill head assembly of claim 1, wherein at least one of the upper bearing and the lower bearing includes tapered roller bearings.

10. The drill head assembly of claim 1, further comprising a water swivel coupled to the second end of the shaft, the water swivel being coaxial with the shaft axis.

11. A drill head assembly, comprising:

a shaft having a first end and an externally threaded second end;

an oscillator assembly configured to generate an oscillating force to the shaft positioned between the first end and the second end;

at least one bearing coupling the shaft to the oscillator assembly; and a preload assembly coupled to the shaft, the preload assembly including:

a base nut configured to be selectively threaded in position on the externally threaded second end of the shaft, and a plurality of preloaders extending through the base nut, wherein advancement of at least one preloader of the plurality of preloaders relative to the base nut to apply a preload force on the at least one bearing.

12. The drill head assembly of claim 11, wherein the preload assembly is associated with the second end of the shaft.

13. The drill head assembly of claim 12, wherein the preload assembly further includes at least one set screw configured to secure the base nut to the second end of the shaft.

14. The drill head assembly of claim 13, further comprising at least one slot formed in the threaded portion.

15. The drill head assembly of claim 13, wherein the base nut includes an upper portion, an inner portion, and a lower portion and wherein an opening is defined in the base nut configured to receive the set screw and extends from the upper portion to the inner portion.

16. The drill head assembly of claim 12, further comprising a top cover selectively coupled to drill head assembly and configured to provide selective access to the preload assembly from a top of the drill head assembly.

17. The drill head assembly of claim 12, further comprising a plurality of bearings including a lower bearing and an upper bearing positioned on opposing sides of the oscillator assembly and wherein the upper bearing is positioned between the oscillator assembly and the preload assembly.

18. The drill head assembly of claim 17, further comprising an air spring assembly located at least partially between the upper bearing and the oscillator assembly.

19. The drill head assembly of claim 16, wherein the shaft includes a shoulder formed near the first end, the shoulder being configured to support the lower bearing wherein the second end is configured to pass through the oscillator assembly, the air spring assembly, and the upper bearing and wherein advancing the preloaders relative to the base nut moves the upper bearings toward the lower bearing on the shaft to thereby apply a preload force to the upper bearing and the lower bearings.

20. A drilling system, comprising:

a rotary head assembly configured to rotate a drill rod; and a sonic head assembly coupled to the rotary head, the sonic head assembly including:

a shaft having a shaft axis defined therein, a plurality of external threads, and a slot extending axially through the plurality of external threads, an oscillator assembly operatively associated with the shaft, the oscillator assembly having at least one eccentrically weighted rotor configured to rotate about a pivot point, wherein an oscillation centerline is defined transverse to the shaft axis and including the pivot point, a lower bearing coupled to the shaft on a first side of the oscillation centerline, an upper bearing coupled to the shaft on a second side of the oscillation centerline, the second side being opposite the first side, an internally threaded base nut adapted to be selectively secured to the plurality of external threads the shaft and thereby apply a preload to the upper bearing and the lower bearing, wherein the base nut includes an opening extending there through, a set screw adapted to interface with the opening and engage the slot of the shaft, thereby rotationally locking the base nut relative to the shaft, and a plurality of preloaders biased against the base nut, the plurality of preloaders being adapted to be advanced relative to the base nut to vary the preload on the upper bearing and the lower bearing, wherein the sonic head assembly is configured to transmit an oscillating vibratory force to the drill rod.

21. The drilling system of claim 20, wherein the plurality of preloaders is accessible from a top of the sonic head assembly.

22. The drilling system of claim 20, wherein the shaft includes a first end and a second end, the sonic head assembly further including a water swivel coupled to the second end and being coaxial with the shaft axis.

* * * * *

UNITED STATES PATENT AND TRADEMARK OFFICE

CERTIFICATE OF CORRECTION

PATENT NO. : 8,006,782 B2
APPLICATION NO. : 12/250894
DATED : August 30, 2011
INVENTOR(S) : Drivdahl et al.

It is certified that error appears in the above-identified patent and that said Letters Patent is hereby corrected as shown below:

Column 4
Line 66, change "center 245" to --centerline 245--

Column 5
Line 7, change "assembly" to --assemblies--
Line 54, change "an" to --a--

Column 6
Line 18, change "air piston 278" to --air piston 276--
Line 49, change "air piston 278" to --air piston 276--
Line 53, change "the force the" to --the force of the--

Column 7
Line 3, change "piston 278" to --piston 276--
Line 10, change "lower seal 270A" to --lower seal 270--
Lines 12-13, change "air piston 278" to --air piston 276--
Line 63, change "base 305" to --base nut 305--

Column 9
Line 32, change "based nut" to --base nut--

Column 10
Line 33, change "to drill head" to --to the drill head--

Column 11
Line 5, change "threads the shaft" to --threads of the shaft--

Signed and Sealed this
Third Day of January, 2012

David J. Kappos

David J. Kappos
*Director of the United States Patent and Trademark Office*